US006875157B1

(12) United States Patent
Wang et al.

(10) Patent No.: US 6,875,157 B1
(45) Date of Patent: Apr. 5, 2005

(54) EMERGENCY SWITCH FOR AN EXERCISE APPARATUS

(76) Inventors: Leao Wang, No. 1, Lane 233, Sec.2, Charng Long Rd., Taiping (TW), 411; Peter Wu, No. 1, Lane 233, Sec.2, Charng Long Rd., Taiping (TW), 411

( * ) Notice: Subject to any disclaimer, the term of this patent is extended or adjusted under 35 U.S.C. 154(b) by 0 days.

(21) Appl. No.: 10/779,371

(22) Filed: Feb. 17, 2004

(51) Int. Cl.[7] ..... A63B 21/00
(52) U.S. Cl. ..... 482/8; 482/1
(58) Field of Search ..... 482/1–9, 900–902

(56) References Cited

U.S. PATENT DOCUMENTS 4,898,378 A * 2/1990 Edwards et al. ..... 482/54
5,556,352 A * 9/1996 Chang ..... 482/52

* cited by examiner

*Primary Examiner*—Glenn Richman

(57) ABSTRACT

The invention relates to an emergency switch for an exercise apparatus having a housing, a safety plug and a microswitch. The safety plug passes through an insertion slot of the housing and is inwardly inserted to the inside of the housing for an electric connection by means of the contact of the distal end of an extension part of the safety plug to a contact key of the microswitch. Meanwhile, an electric disconnection is created when the safety plug is extracted. In addition, a cut-off button with a push rod is interposed between the safety plug and the microswitch. Besides, the cut-off button projects outwardly from the housing. When the cut-off button is pressed down, the push rod makes use of its slanting guide face to separate the safety plug from the contact key of the microswitch into a disconnection state.

1 Claim, 4 Drawing Sheets

EMERGENCY SWITCH FOR AN EXERCISE APPARATUS

BACKGROUND OF THE INVENTION

1. Fields of the Invention

The invention relates to an emergency switch for an exercise apparatus, and more particularly, to a switch combining a safety plug and a cut-off button in dual mode for disconnection of power supply in an emergency. Therefore, the safety in using the exercise apparatus is more ensured.

2. Description of the Related Art

Most of the conventional exercise apparatus (e.g. treadmill, oval-track exercise device, etc.) driven by electric motor include an emergency switch in the circuit controller (so-called electric console) for an immediate cutoff of the power supply to stop the motor, thereby ensuring the safety of the operator.

The most common way to disconnect power supply is to utilize a safety plug in cooperation with a microswitch having a contact key. An electric connection and disconnection is established by contact and separation of the both elements, respectively. However, the safety plug has to be connected with a band and a clamping element, and the other end of the clamping element is fixed at a certain place of the operator's body. Thus, the safety plug is extracted from the contact with the contact key of the microswitch, thereby cutting off the power supply when the clamping element or the band is outwardly pulled by an external force in an emergency.

However, it's uncomfortable and inconvenient for operators to fix the clamping element to their body so that many people don't want to use it. Consequently, the conventional emergency switch doesn't work in an emergency.

Another type of emergency switch includes a cut-off button on the electric control panel for replacing the above-mentioned safety plug. However, it's difficult for operator in an emergency to press down this emergency button duly and correctly. Therefore, the use of this kind of emergency switch is a little risky.

SUMMARY OF THE INVENTION

In light of the demerits of the prior art, the invention provides an emergency switch for an exercise apparatus that aims to combine the above-mentioned conventional emergency switches in one apparatus and to provide a useful alternative.

A primary objective of the invention is to provide an emergency switch for an exercise apparatus having a movable safety plug and a fixed cut-off button. In case of emergency, the operator can take either measure for an immediate disconnection of power supply. Therefore, the safety of the operator during the exercise session is more ensured.

Therefore, a cut-off button with a push rod is interposed between the safety plug and the microswitch. Besides, the cut-off button projects outwardly from the housing. When the cut-off button is pressed down, the push rod makes use of its slanting guide face to separate the safety plug from the contact key of the microswitch into a disconnection state.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
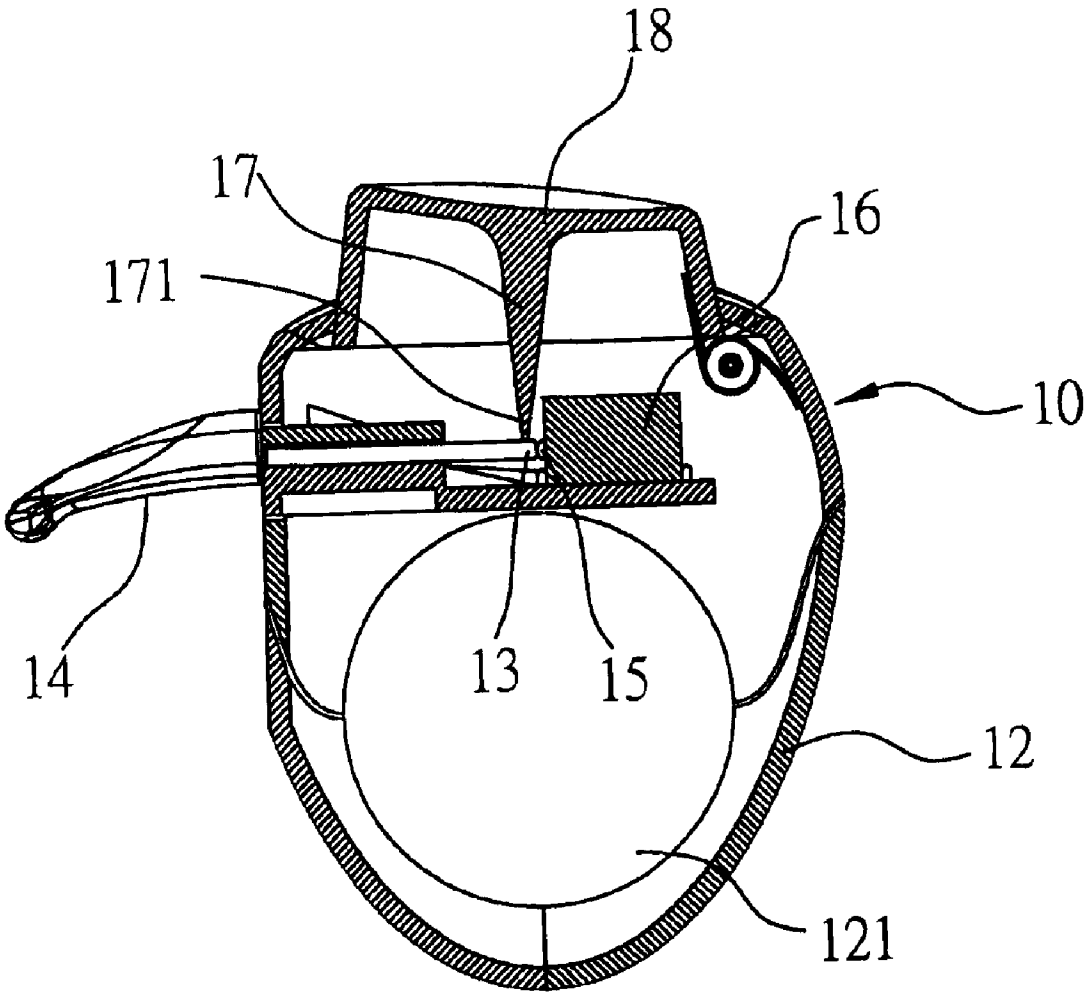
FIG. 1 is a cutaway view of a preferred embodiment of the invention.
Figure 2:
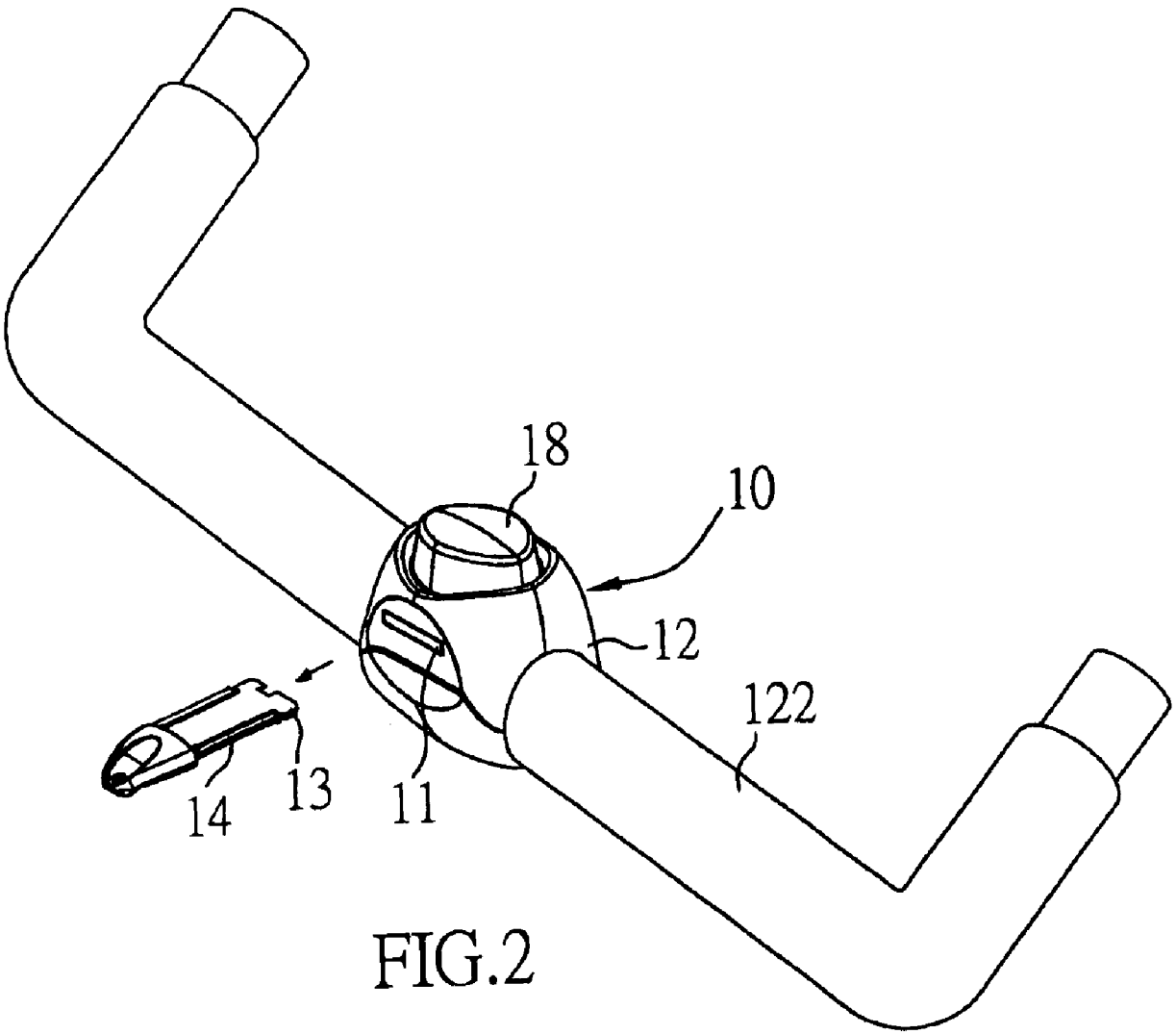
FIG. 2 is a perspective view of the preferred embodiment of the invention in accordance with FIG. 1.

Referring to FIGS. 1 and 2, a preferred embodiment of the invention is shown. From the figures, an individually operated circuit system is provided for establishing an electric connection or disconnection of power supply to a motor (not shown). The emergency switch 10 of the invention includes a housing 12, a safety plug 14 and a microswitch 16. The safety plug 14 passes through an insertion slot 11 of the housing 12 and is inwardly inserted to the inside of the housing 12 for an electric connection by means of the contact of the distal end of an extension part 13 of the safety plug 14 to a contact key 15 of the microswitch 16. Meanwhile, an electric disconnection is created when the safety plug 14 is extracted.

Figure 3:
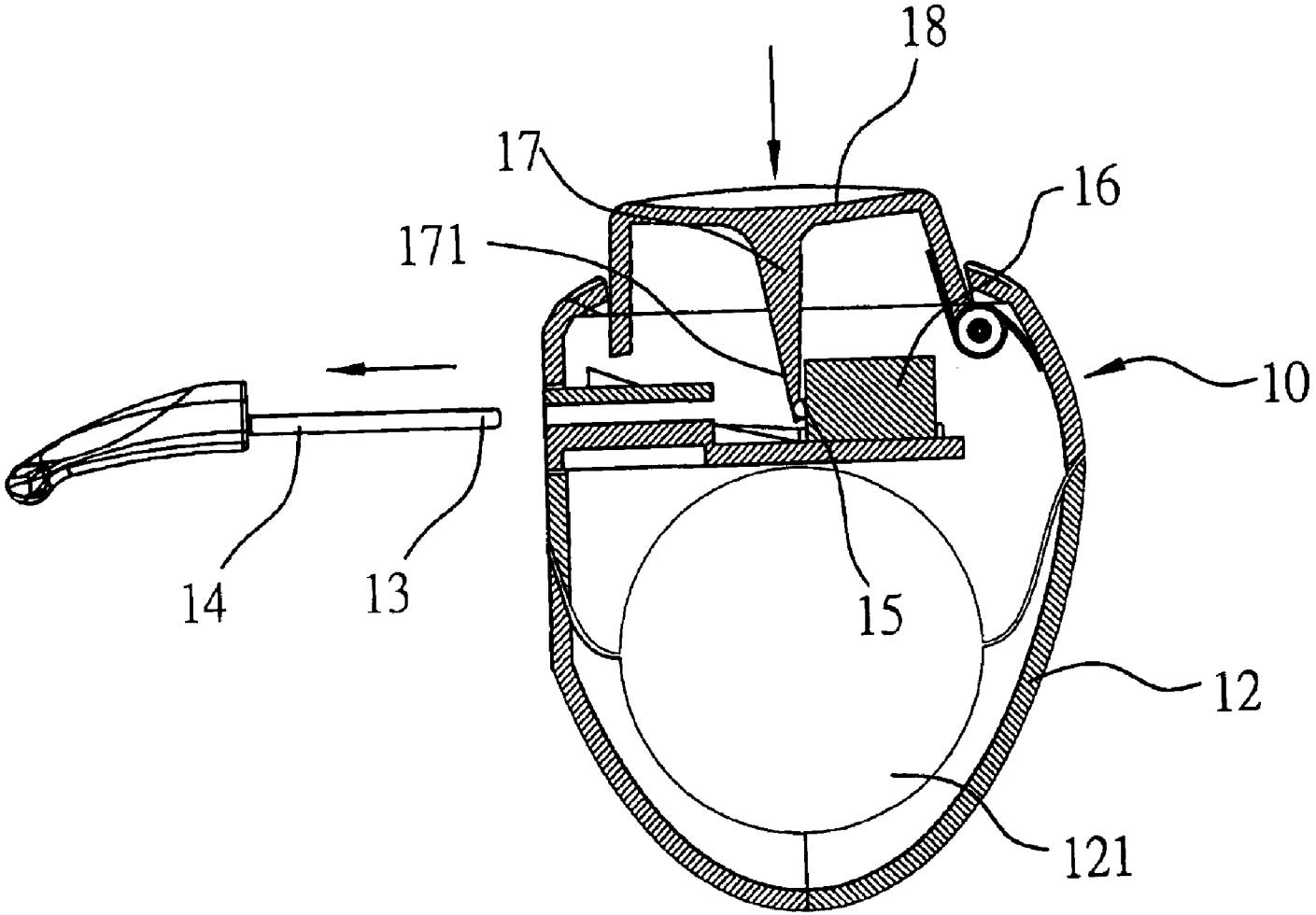
FIG. 3 is a cutaway view of the preferred embodiment of the invention with the extracted safety plug.

In addition, a cut-off button 18 with a push rod 17 is interposed between the safety plug 14 and the microswitch 16. Besides, the cut-off button 18 projects outwardly from the housing 12. When the cut-off button 18 is pressed down, the push rod 17 makes use of its slanting guide face 171 to separate the safety plug 14 from the contact key 15 of the microswitch 16 into a disconnection state (see FIG. 3).

Of course, the housing 12 includes a through hole for putting the emergency switch 10 on a mounting tube 122 of the exercise apparatus. This is a basic installation technique so that no further descriptions are given hereinafter.

Figure 4:
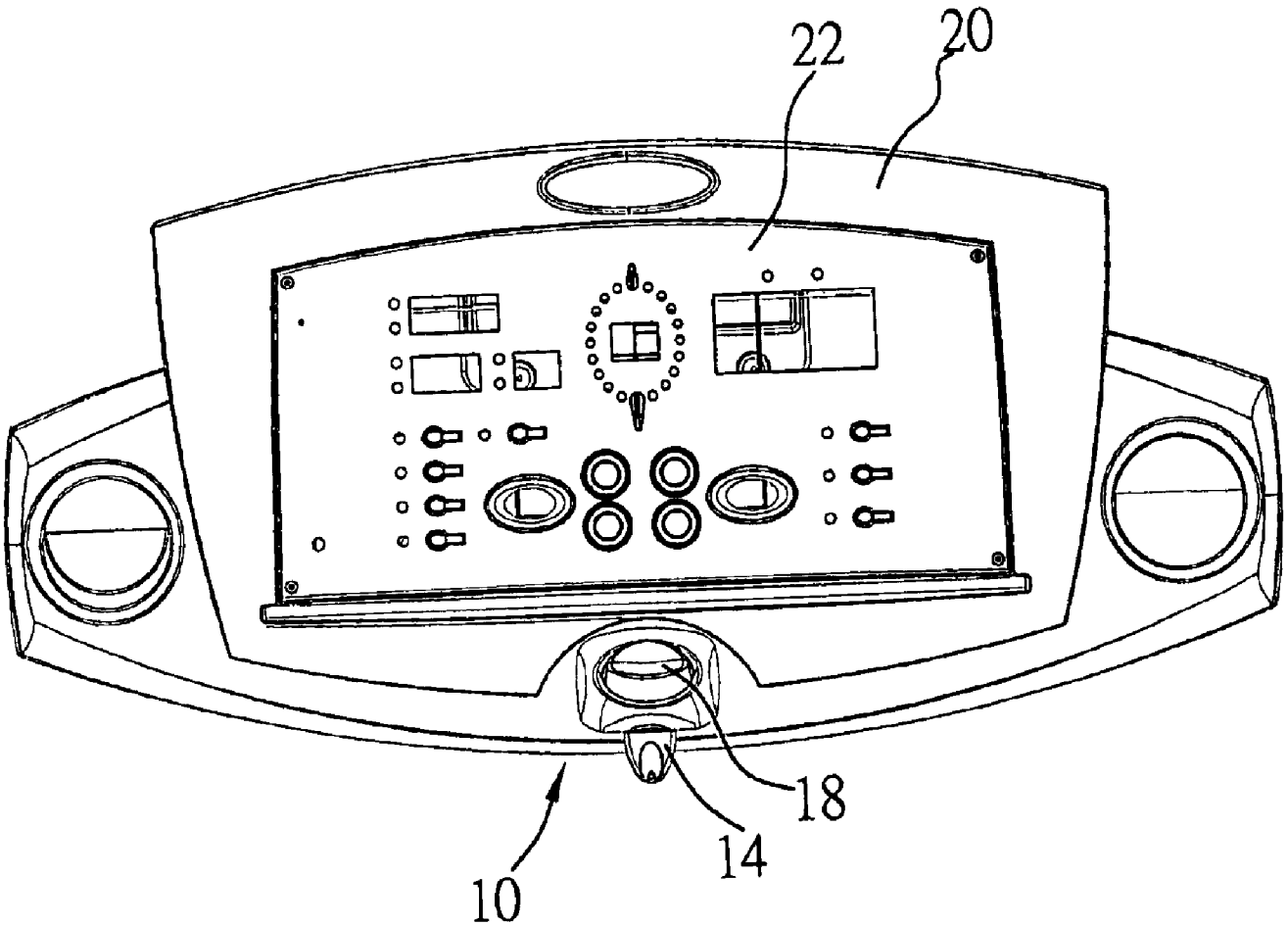
FIG. 4 is a schematic drawing of the invention mounted on a mounting tube of the electric console for an exercise apparatus.

Furthermore, as shown in FIG. 4, the emergency switch 10 of the invention is integrated in a circuit controller 20 (or electric console). In addition to a conventional control panel 22, the circuit controller 20 further contains the cut-off button 18 and the safety plug 14 of the invention.

The microswitch 16 and the circuit controller 20 are commercially available and have been widely applied to all kinds of exercise apparatuses. Moreover, the operational principle and the circuit connection thereof belong to the prior art. Therefore, no further descriptions are given hereinafter, either.

After the cut-off button 18 is pressed down to force the safety plug 14 in disconnection with the contact key 15 of the microswitch 16, the exercise apparatus can be running again only when the operator brings the safety plug 14 to its original position for a closed circuit. In this way, the exercise apparatus can be more safely used and an unintentional activation of the exercise apparatus can be avoided.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claim.

What is claimed is:

1. An emergency switch for an exercise apparatus comprising:

a) a housing;

b) a microswitch disposed within the housing;

c) a safety plug passing through an insertion slot of the housing and being inwardly inserted to the inside of the housing for an electric connection by means of the contact of the distal end of an extension part of the safety plug to a contact key of the microswitch while an electric disconnection is created in extracting the safety plug; and d) a cut-off button with a push rod interposed between the safety plug and the microswitch, the cut-off button projecting outwardly from the housing, the push rod having a slanting guide face;

whereby, when the cut-off button is pressed down, the push rod makes use of its slanting guide face to separate the safety plug from the contact key of the microswitch into a disconnection state.

* * * * *